US008689528B1

(12) United States Patent
Gaspari et al.

(10) Patent No.: US 8,689,528 B1
(45) Date of Patent: Apr. 8, 2014

(54) METHOD OF PACKAGING A PLURALITY OF TISSUES FOR DISPENSING

(71) Applicants: Seda Gaspari, Los Angeles, CA (US); Mike H. Ananighian, Los Angeles, CA (US)

(72) Inventors: Seda Gaspari, Los Angeles, CA (US); Mike H. Ananighian, Los Angeles, CA (US)

( * ) Notice: Subject to any disclaimer, the term of this patent is extended or adjusted under 35 U.S.C. 154(b) by 0 days.

(21) Appl. No.: 13/931,524

(22) Filed: Jun. 28, 2013

Related U.S. Application Data

(63) Continuation-in-part of application No. 13/291,491, filed on Nov. 8, 2011, now abandoned.

(51) Int. Cl.

| | |
|---|---|
| ***B65B 25/14*** | (2006.01) |
| ***B65B 63/04*** | (2006.01) |
| ***B65D 83/08*** | (2006.01) |
| ***B65H 45/24*** | (2006.01) |
| ***A47K 10/42*** | (2006.01) |
| *B65H 45/22* | (2006.01) |

(52) U.S. Cl.

CPC ..... *A47K 10/42* (2013.01); *B65D 83/0805* (2013.01); *B65B 25/145* (2013.01); *B65B 63/04* (2013.01); *B65H 45/228* (2013.01); *A47K 2010/428* (2013.01)

USPC ..... 53/429; 53/435; 206/494; 221/48; 270/39.06

(58) Field of Classification Search

CPC . A47K 10/42; A47K 2010/428; B65H 45/24; B65H 45/228; B65D 83/0805; B65B 25/145; B65B 63/04

USPC ..... 53/429, 435, 117, 520; 206/494; 221/48; 270/39.05, 39.06

IPC ..... B65D 83/08; B65H 45/24; A47K 10/42

See application file for complete search history.

(56) References Cited

U.S. PATENT DOCUMENTS

| | | | | | |
|---|---|---|---|---|---|
| 1,860,812 | A | * | 5/1932 | Marshall | 206/494 |
| 1,911,548 | A | * | 5/1933 | Campbell | 206/494 |
| 1,962,762 | A | * | 6/1934 | Campbell | 206/494 |
| 1,980,059 | A | * | 11/1934 | Housen | 206/494 |
| 1,996,307 | A | * | 4/1935 | Shapiro | 206/494 |
| 2,002,691 | A | * | 5/1935 | Cofrin | 206/494 |
| 2,260,488 | A | * | 10/1941 | Shapiro | 206/494 |
| 3,581,935 | A | * | 6/1971 | Chi | 221/49 |
| 4,785,970 | A | * | 11/1988 | Engelmayer | 221/47 |
| 5,118,554 | A | * | 6/1992 | Chan et al. | 206/494 |
| 5,242,057 | A | * | 9/1993 | Cook et al. | 206/494 |

(Continued)

FOREIGN PATENT DOCUMENTS

WO WO 2009123123 A1 * 10/2009 ..... B65D 83/08

*Primary Examiner* — Stephen F Gerrity

(74) *Attorney, Agent, or Firm* — Patent Law & Venture Group; Gene Scott

(57) ABSTRACT

A method of adapting a plurality of tissues for dispensing, includes cutting each tissue into a rectangular shape having a length and a width; folding each tissue in half lengthwise into a first attitude having the same length and one-half of the width; folding each tissue in half lengthwise again into a second attitude having the same length and having only one-quarter of the original width; placing an even number of equally spaced, widthwise folds, in the tissue dividing the tissue into an odd number of rectangular portions arranged in a Z-folded accordion arrangement; and aligning the plurality of folded tissues in a linear sequence with one rectangular portion of each succeeding folded tissue in the sequence engaged between two adjacent rectangular portions of a preceding folded tissue in the sequence.

3 Claims, 2 Drawing Sheets

(56) References Cited

U.S. PATENT DOCUMENTS

| | | | | |
|---|---|---|---|---|
| 5,295,579 | A * | 3/1994 | Focke et al. | 206/494 |
| 5,524,759 | A * | 6/1996 | Herzberg et al. | 206/494 |
| 6,012,572 | A * | 1/2000 | Heathcock et al. | 206/494 |
| 6,296,144 | B1 * | 10/2001 | Tanaka et al. | 206/494 |
| 6,641,894 | B2 * | 11/2003 | Bando | 206/494 |
| 6,685,050 | B2 * | 2/2004 | Schmidt et al. | 206/494 |
| 6,880,704 | B2 * | 4/2005 | Bredahl | 206/494 |
| 7,204,390 | B2 * | 4/2007 | Widlund | 221/48 |
| 2001/0025856 | A1 * | 10/2001 | Lefevre Du Grosriez et al. | 221/33 |
| 2002/0070141 | A1 * | 6/2002 | Iida | 206/494 |
| 2006/0157495 | A1 * | 7/2006 | Reddy et al. | 221/47 |

* cited by examiner

METHOD OF PACKAGING A PLURALITY OF TISSUES FOR DISPENSING

RELATED APPLICATIONS

In part, this application describes the same apparatus and method as presented in non-provisional application Ser. No. 13/291,491, filed on Nov. 8, 2011, now abandoned and claims international date priority thereof as a Continuation-In-Part application. The subject matter of application Ser. No. 13/291,491 is hereby incorporated herein by reference in its entirety.

BACKGROUND

This disclosure relates to sanitary papers, and more particularly to a package for holding such papers, and a method of folding and dispensing such papers.

Sanitary papers such as napkins, facial tissues, and the like (hereinafter referred to by the term "tissues" are typically stored and sold in and dispensed from paperboard packaging. For many purposes, this presents no complications. However, where sanitary conditions must be maintained, it is objectionable to require that the user insert a hand into the package in order to retrieve a tissue, due to potential transfer of contamination into the remaining supply of tissues. Another issue for packaged tissues is that of compactness. Most tissues are sold at retail in boxes which are inconvenient to carry about. For instance, one commercially available tissue box for the home is 4.5 inches in width and nine inches long. This box is sold in two sizes; one being 2.25 inches deep and the other being about twice that depth, and both dispense a two-ply tissue that is eight inches square and folded only once centrally so as to be opened to full size quickly. Another popular tissue box, typically small enough to be placed on a vanity, is 4.5 inches square and 5 inches deep and dispenses the same eight inch square two-ply tissue. To fit into the smaller box, the entire set of tissues is placed into the box in a bent-over, U-shaped arrangement. To solve the contamination problem, these larger boxes of tissues have one tissue interleaved with the next so that when one is withdrawn from the box, the next tissue "pops-up" partly extending from the top of the box in readiness for being gripped for being quickly withdrawn. When sensing an impending sneeze or cough, it is desirable, and in some instances, imperative, to be able to grip such a next tissue so as to withdraw it quickly in order to "catch" the cough or sneeze. It is also important to be able to open a withdrawn tissue quickly to full size.

A more compact tissue package is commercially available at this time. This package has a flexible plastic wrapper three-by-four inches in size and about one-half inch in thickness and folds opens to reveal a number of tissues in two opposing pockets. The tissues in this package are first folded twice in a first direction and then twice in the orthogonal direction. These tissues cannot be opened to full useful size quickly. Once pulled out of the package these tissues do not provide a pop-up feature and it is easy to pull out more than one tissue at a time if not careful in selecting each next tissue. Unfortunately, there is presently no smaller tissue package that provides for the pop-up enablement and quick unfolding.

The presently described apparatus and method of use provides for a clever and novel solution to compact packaging, the pop-up feature and relatively quick opening of the tissue once withdrawn from its package.

BRIEF SUMMARY

The present invention addresses the above stated need by providing a novel folding scheme in combination with packaging that is both compact and also provides the pop-up feature. The tissues are folded in half and then in half again with both folds running parallel to each other. The tissues are then folded a number of times crossways in accordion style to achieve a small rectangular size. The tissues are interleaved to enable the pops-up feature. The dispensing aperture is narrow so that as a tissue is dispensed it unfolds to its full length which is easily opened to its full width by merely pulling apart two free edges. This novel folding and packaging scheme thus accomplishes the goals of maintaining hygienic conditions, miniaturization, and ease of use. Objects of the apparatus and method of use of packaged tissues as described herein include improved hygienic conditions, miniaturization, and quick withdrawal and unfolding. These and other objects of the present invention will become readily apparent upon further review of the following description and drawings and from the claims.

BRIEF DESCRIPTION OF THE DRAWINGS

Like reference symbols in the various drawings indicate like elements.

DETAILED DESCRIPTION

Figure 1:
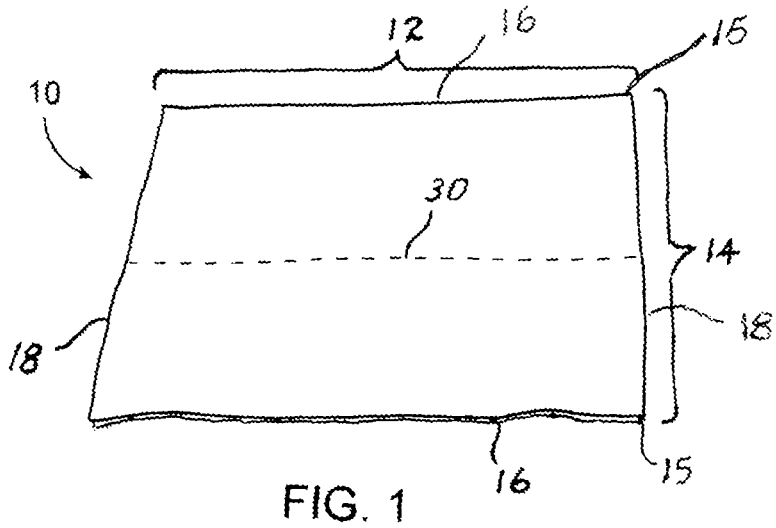
FIG. 1 is a perspective view of an unfolded tissue as provided by the present method.

The presently described package and method enables pop-up dispensing of a plurality of tissues 10 from a tissue box 20 (FIG. 6) that may be conveniently carried on one's person or in a handbag for instance. Once dispensed, a tissue 10 is able to be unfolded with a single motion due to the manner in which the tissue 10 is folded and the manner by which the tissue 10 is dispensed with two free corners 15 in positions for being pulled apart to thereby immediately spread the tissue 10 fully open. The method of folding and interleaving tissues 10 is partly responsible for the advantages and benefits previously described.

In the following description, referring to FIG. 1, a tissue 10 may be of single-ply, double-ply, or triple-ply but still referred to as tissue 10 (singular). The term "lengthwise," as used herein, means that a respective lengthwise fold is oriented in parallel with the edges 16 of the tissue 10, wherein such edges 16 define the length 12 of the tissue 10. Likewise, the term "widthwise," as used herein, means that a respective widthwise fold is oriented in parallel with the edges 18 of the tissue 10 that define the width 14 of tissue 10. In the following, tissue 10 will be referred to alternately as tissue 10-1, tissue 10-2, and tissue 10-3 depending on its folded condition as a sequence of folding steps is described. However, reference numerals 10, 10-1, 10-2 and 10-3 refer to the same tissue, that is, tissue 10, while the dash numerals: -1, -2, -3 identify the folded condition of tissue 10.

Figure 2:
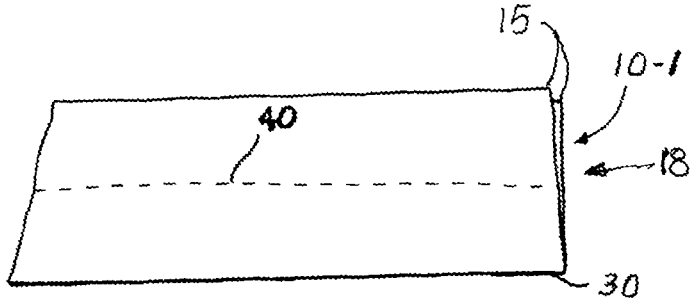
FIG. 2 is a perspective view of the tissue shown folded in half lengthwise according to the present method.

In the present method, first, a plurality of planar tissues 10 are each cut into a rectangular shape identical to the tissue 10 shown in FIG. 1. Each tissue 10 has a length dimension 12 and a width dimension 14 which dimensions are referred to herein simply by the terms "length" and "width" and these dimensions are related to the respective edges of tissue 10, that is, edges 16 defining the length 12 of tissue 10, and edges 18 define the width 14 of tissue 10. Each tissue 10 is folded in the following manner, starting with folding the rectangular shape shown in FIG. 1, in half lengthwise along line 30 thereby creating a first folded arrangement 10-1 as shown in FIG. 2, having the length 12 and one-half of width 14. The term "folded" as used herein means that the tissue 10 is creased with one portion of tissue 10 lying on one side of the crease and a second portion of tissue 10 lying on the opposite side of the crease and placing the two opposing sides in face-to-face contact as shown in FIG. 2.

Figure 3:
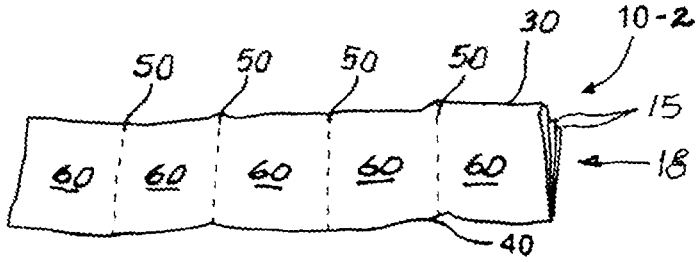
FIG. 3 is a perspective view of the tissue shown folded in half again lengthwise according to the present method.

Next, the first folded arrangement 10-1 is folded in half lengthwise a second time along line 40 in FIG. 2 forming a folded second arrangement 10-2 having the length 12 and having one-quarter of the width 14 as shown in FIG. 3.

Figure 4:
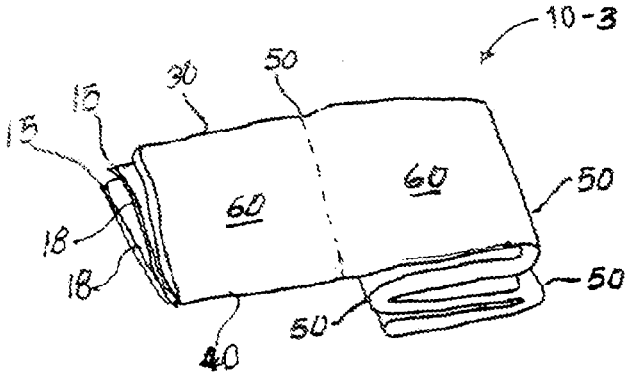
FIG. 4 is a perspective view of the tissue shown folded widthwise in accordion style with equally spaced apart folds producing equal sized panels according to the present method.
Figure 5:
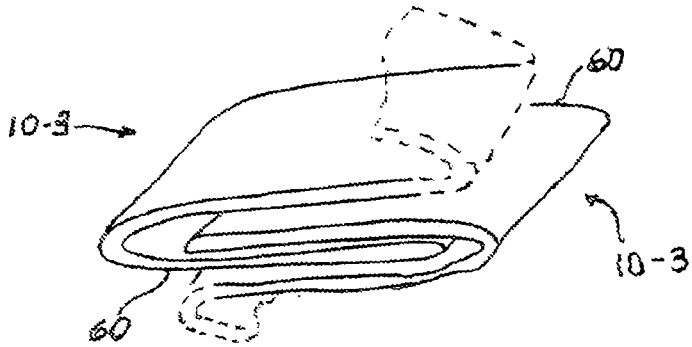
FIG. 5 is a perspective view of two of the tissues shown as folded in FIG. 4, in an interleaved relationship.

Next, an even number of equally-spaced, widthwise folds, as indicated by dashed lines 50, are made thereby dividing tissue 10-2 into an odd number of equally sized rectangular portions 60 and creating a Z-folded accordion arrangement 10-3 as shown in FIG. 4. Finally, the plurality of folded tissues 10-3 are aligned in a stack with one tissue 10-3 on top of the next. As shown in FIG. 5 the first rectangular portion 60 of each subsequent tissue 10-3 in the stack is inserted between the last two rectangular portions 60 of each preceding tissue 10-3 thereby producing an interleaved arrangement of the tissues 10 with the stack containing two or more, and preferably at least ten of tissues 10-3. Because of this interleaved relationship, when a topmost tissue 10-3 is withdrawn from tissue box 20, as shown in FIG. 6, the next tissue 10-3 in the stack is partially drawn through an open slot 22 in tissue box 20 and into a position where it is easily grasped and withdrawn when needed.

Figure 6:
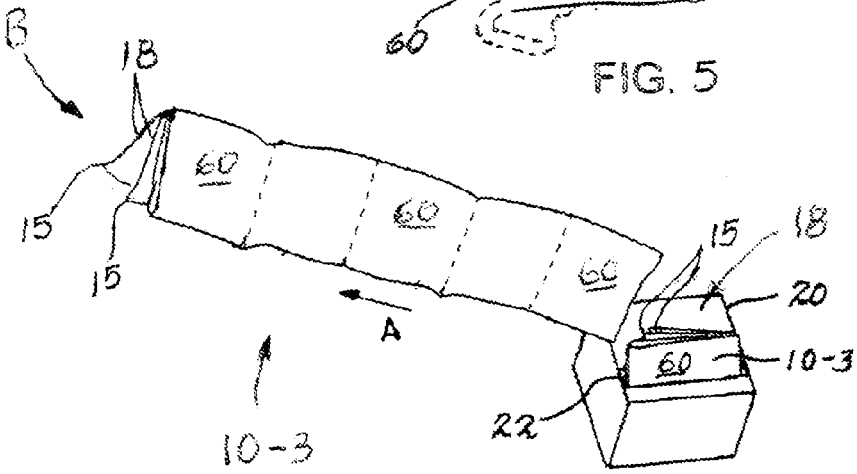
FIG. 6 is a perspective view of a tissue package holding a plurality of the tissues with one of the tissues shown dispensed and fully extended in length and a further tissue "popped-up" in a position for being withdrawn from the container.

As shown in FIGS. 3, 4, and 6 tissues 10, when folded has four layers. Open slot 22 in tissue box 20 is specifically of a width that compresses tissue 10-2 providing a frictional drag as tissue 10-4 is withdrawn through open slot 22, that is, it unfolds to its full length 12 during the withdrawal process as shown in FIG. 6, see arrow "A". Open slot 22 is narrow enough to exert a sliding pressure on opposing sides of tissue 10-3 so that it is forced to unfold along fold lines 50 (FIG. 3). Because tissue 10 is folded as described above, widthwise edges 18 and corners 15 are presented as shown in FIGS. 3 and 6. The specific portion of tissue 10 that is partly extending out of slot 22 is gripped when withdrawing the tissue 10. See the edges 18 referred to by arrow "B" in FIG. 6. Therefore, the act of withdrawing tissue 10 accomplishes pulling tissue 10 to its full length 12, and also places edges 18 and corners 15 between the fingers of the hand that grips tissue 10 and withdraws it. Then, one need only grasp the two edges 18 at corners 15 to pull tissue 10 to its full open state as shown in FIG. 1.

In the present method an even number of widthwise folds 50 are made in each tissue 10-3 so that an odd number of rectangular portions 60 are created as shown in FIG. 3. In this manner each tissue 10-3 has first and last portions 60 terminating in opposing directions which enables the first portion 60 of each succeeding tissue 10-3 to be inserted between the last two portions 60 of the preceding tissue 10-3 thereby enabling pop-up action during the withdrawal of each tissue 10.

In one embodiment, the tissues 10 are eight inches square before folding and the rectangular portions 60 are each 1.6 by 2.0 inches. Other embodiments may have other sizes and dimensions.

Embodiments of the subject apparatus and method have been described herein. Nevertheless, it will be understood that various modifications may be made without departing from the spirit and understanding of this disclosure. Accordingly, other embodiments and approaches are within the scope of the following claims.

What is claimed is:

1. A method of packaging a plurality of tissues for dispensing, the method consisting of:

cutting each said tissue into a rectangular shape having a length and a width;

folding each said tissue in half lengthwise into a first folded arrangement having said length and one-half of said width;

folding each said tissue having the first folded arrangement in half lengthwise a second time thereby forming a second folded arrangement having said length and having one-quarter of said width;

placing an even number of equally spaced, widthwise folds in each said tissue having the second folded arrangement thereby dividing said tissue into an odd number of rectangular portions;

folding the each said tissue in a Z-folded accordion arrangement;

stacking the plurality of tissues with one said rectangular portion of each succeeding tissue between two rectangular portions of each preceding tissue to thereby form a stack of said tissues;

placing the stack of said tissues within a box, the box having an open slot;

engaging a portion of one of the tissues in the stack with the open slot wherein the slot presses from opposing sides on the one of the tissues;

withdrawing the one of the tissues thereby causing the one of the tissues to extend to its full length; and gripping and pulling in opposing directions on corners of the one of the tissues thereby fully unfolding the one of the tissues.

2. A method of packaging a plurality of tissues for dispensing, the method consisting of:

folding each said tissue in half lengthwise;

folding each said tissue in half lengthwise a second time;

placing an even number of equally spaced, widthwise folds in each said tissue thereby dividing said tissue into an odd number of rectangular portions arranged in a Z-folded accordion arrangement;

stacking the plurality of tissues with one said rectangular portion of each succeeding tissue in said stack engaged between two rectangular portions of a preceding tissue in said stack;

placing the stack of said tissues into a package having a dispensing aperture through which the tissues are able to be withdrawn;

exerting an aperture force on opposing sides of each said tissue during withdrawal through the aperture to thereby extend each said dispensed tissue to a full length.

3. A method of packaging a plurality of planar 8 inch square shaped tissues for dispensing, the method consisting of:

folding each said tissue in half lengthwise;

folding each said tissue in half lengthwise a second time;

placing four equally spaced, widthwise folds in each said tissue thereby dividing said tissue into five 1.6 by 2.0 inch rectangular portions arranged in a Z-folded accordion arrangement;

stacking the plurality of tissues with one said rectangular portion of each succeeding tissue in said stack engaged between two rectangular portions of a preceding tissue in said stack;

and placing the stack of said tissues into a package having a dispensing aperture through which the tissues are able to be withdrawn with pressure exerted on opposing sides of said tissues.

* * * * *